US008340551B2

(12) United States Patent
Yamanaka et al.

(10) Patent No.: US 8,340,551 B2
(45) Date of Patent: Dec. 25, 2012

(54) IMAGE FORMING APPARATUS HAVING A PHOTOCONDUCTOR CONTAINING TITANYLPHTHALOCYANINE

(75) Inventors: Takayuki Yamanaka, Osaka (JP); Koichi Toriyama, Osaka (JP); Kotaro Fukushima, Osaka (JP); Masanori Matsumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 252 days.

(21) Appl. No.: 12/783,043

(22) Filed: May 19, 2010

(65) Prior Publication Data

US 2010/0303500 A1 Dec. 2, 2010

(30) Foreign Application Priority Data

May 26, 2009 (JP) ..... 2009-126403

(51) Int. Cl.
*G03G 21/06* (2006.01)
*G03G 15/00* (2006.01)

(52) U.S. Cl. ..... 399/128; 399/159

(58) Field of Classification Search ..... 399/128, 399/159

See application file for complete search history.

(56) References Cited

U.S. PATENT DOCUMENTS

2007/0172752 A1* 7/2007 Niimi ..... 430/123.43

FOREIGN PATENT DOCUMENTS

| | | |
|---|---|---|
| JP | 2000-007935 | 1/2000 |
| JP | 2000-199976 A | 7/2000 |
| JP | 2000-330307 A | 11/2000 |
| JP | 2003-149837 A | 5/2003 |
| JP | 2005-181991 | 7/2005 |
| JP | 2006-208764 A | 8/2006 |
| JP | 2006-259018 | 9/2006 |
| JP | 2007-011116 | 1/2007 |
| JP | 2007-226189 A | 9/2007 |

* cited by examiner

*Primary Examiner* — Hoang Ngo
(74) *Attorney, Agent, or Firm* — Nixon & Vanderhye P.C.

(57) ABSTRACT

The present invention therefore provides an image forming apparatus, comprising: a photoconductor; a charge means for charging the photoconductor; an exposure means for irradiating a surface of the photoconductor with light to form an electrostatic latent image; a development means for developing the electrostatic latent image formed; a transfer means for transferring the image developed onto a paper sheet; and a discharge means for irradiating the surface of the photoconductor with light to eliminate charges, wherein the photoconductor contains a titanylphthalocyanine having absorption bands in a wavelength region of 380 nm to 420 nm and a wavelength region of 600 nm to 850 nm as a charge generation material, the exposure means irradiates the surface of the photoconductor with light having a wavelength of 380 nm to 420 nm to form the electrostatic latent image, and the discharge means irradiates the surface of the photoconductor with light having a wavelength of 600 nm to 850 nm to eliminate the charges.

4 Claims, 2 Drawing Sheets

IMAGE FORMING APPARATUS HAVING A PHOTOCONDUCTOR CONTAINING TITANYLPHTHALOCYANINE

CROSS-REFERENCE TO RELATED APPLICATION

This application is related to Japanese Patent Application No. 2009-126403 filed on 26 May, 2009, whose priority is claimed under 35 USC §119, and the disclosure of which is incorporated by reference in its entirety.

BACKGROUND OF THE INVENTION

1. Field of the Invention

The present invention relates to an electrophotographic image forming apparatus such as copying machines, facsimiles, and printers using an electrophotographic system.

More particularly, the present invention relates to an electrophotographic image forming apparatus comprising: an exposure section using blue laser having a short wavelength as writing exposure light; a discharge section using red LED having a long wavelength as discharge light; and an electrophotographic photoconductor containing a charge generation material having absorption ranges for both the wavelengths.

2. Description of the Related Art

Image formation of an electrophotographic system is performed by repeating steps of charging, exposing, developing, transferring, cleaning, and discharging around a photoconductor.

In recent years, concerning image quality, demands for higher printing resolution have increased combined with demands for higher definition and colorization.

In order to obtain higher printing resolution, it is necessary to make the diameter of an exposure spot smaller. And, in order to make the diameter of the exposure spot smaller, it is effective to shorten the oscillation wavelength of its light source.

For example, when a short-wavelength laser having an oscillation wavelength that is approximately half that of a conventional laser in a near-infrared region is used as the light source, the spot diameter of the laser beam on a photosensitive layer can be theoretically decreased by almost half as indicated by the following formula (1):

$$d \propto (\pi/4)(\lambda f/D) \quad (1)$$

wherein d is a spot diameter on the photosensitive layer, $\pi$ is the circular constant, $\lambda$ is a wave length of the laser beam, f is a focal length of an f $\theta$ lens, and D is a diameter of the lens.

Thus, shortening of the oscillation wavelength of the exposure light is very advantageous to increase of the writing density for latent images, that is, increase of the resolution.

Meanwhile, since the energy of individual photons increases in inverse proportion to wavelength, blue light having a short wavelength in a near-ultraviolet region is more likely to chemically change substances by photo-deterioration compared with red light having a long wavelength as the substances are repeatedly exposed to the short-wavelength light for or over a long period of time.

That is, substances (charge generation material and/or charge transfer material included in a photoconductor in the case of an electrophotographic image forming apparatus) exposed to light having a short wavelength over a long period of time are subjected to photo-deterioration.

Japanese Unexamined Patent Publication No. 2005-181991 discloses use of discharge light having a wavelength longer than that of exposure light. In Japanese Unexamined Patent Publication No. 2005-181991, however, the relationship in the wavelength between the discharge light and the exposure light is within a range of 380 nm to 520 nm, and blue light having a wavelength of 520 nm or less is still used as the discharge light. That is, the photoconductor is still subjected to photo-deterioration as used over a period of time.

Photoconductors are irradiated with light in an exposing step by an exposure means and in a discharging step by a discharge means.

The discharging step is to eliminate unevenness of charges remaining on the surface of the photoconductor after a transferring step and a cleaning step by applying light to the whole area of the photoconductor, and is necessary to regain an evenly charged state in a subsequent charging step.

Generally, the amount of discharge light is approximately 3 times to 5 times the amount of exposure light.

The exposure light is applied only to an image region, more specifically to an image part of the image region after being modulated to be in an amount according to each image density. On the other hand, the discharge light is applied to the whole region in a constant amount before the charging step.

That is, in a series of image formation processes of charge, exposure, development, transfer, cleaning, and discharge, the exposure means applies light in an amount according to the image density to the photoconductor only in part corresponding to the size of the image, more specifically in part where the image exists.

On the other hand, the discharge means necessarily applies light in an amount 3 times to 5 times the maximum amount of the exposure light to the whole region before the charging step in the above-described series of image formation processes.

That is, most of the light to be applied to the photoconductor is discharge light.

Generally, in image forming apparatuses for high printing resolution in which blue light having a short wavelength is used for exposure writing, photoconductors having sensitivity in a region of the short wavelength are used, and therefore, in the discharging step, light having sensitivity in the wavelength region, that is, blue light is used for discharge as well. Accordingly, in image forming apparatuses that perform exposure with light having a short wavelength and discharge with light having a short wavelength, photoconductors are always exposed to light having a short wavelength, and the performance thereof deteriorates due to photo-deterioration as used over a period of time to cause degradation of images.

SUMMARY OF THE INVENTION

It is therefore an object of the present invention to provide an image forming apparatus that is unlikely to experience photo-deterioration accompanied by use over a long period of time and that allows stable printing for high printing resolution.

The inventors of the present invention have made intensive studies and efforts to solve the above-described problems and, as a result, found that use of an exposure means and a discharge means for providing exposure light and discharge light that are different in wavelength, and use of a charge generation material having absorption of light in both short wavelength and long wavelength regions for a photoconductor can solve the above-described problems to complete the present invention.

The present invention therefore provides an image forming apparatus, comprising: a photoconductor; a charge means for charging the photoconductor; an exposure means for irradiating a surface of the photoconductor with light to form an electrostatic latent image; a development means for developing the electrostatic latent image formed; a transfer means for transferring the image developed onto a paper sheet; and a discharge means for irradiating the surface of the photoconductor with light to eliminate charges, wherein the photoconductor contains a titanylphthalocyanine having absorption bands in a wavelength region of 380 nm to 420 nm and a wavelength region of 600 nm to 850 nm as a charge generation material, the exposure means irradiates the surface of the photoconductor with light having a wavelength of 380 nm to 420 nm to form the electrostatic latent image, and the discharge means irradiates the surface of the photoconductor with light having a wavelength of 600 nm to 850 nm to eliminate the charges.

image forming apparatus comprising: a photoconductor containing a titanylphthalocyanine having absorption in a wavelength region of 380 nm to 420 nm and a wavelength region of 600 nm to 850 nm as a charge generation material; an exposure means for providing exposure light having a wavelength of 380 nm to 420 nm; and a discharge means for providing discharge light having a wavelength of 600 nm to 850 nm.

The present invention also provides an image forming apparatus, wherein the titanylphthalocyanine is a crystalline titanylphthalocyanine having major peaks in an X-ray diffraction spectrum for CuKα characteristic X-rays (wavelength: 1.5418 Å) at Bragg angles (2θ±0.2°) of 7.3°, 9.4°, 9.6°, and 27.2°, in which a peak bundle formed by overlapping the peaks at 9.4° and 9.6° is the largest peak, and the peak at 27.2° is the second largest peak.

The present invention also provides an image forming apparatus wherein the exposure means is for printing for high printing resolution.

The present invention also provides an image forming apparatus wherein the exposure means is a blue semiconductor laser.

The present invention further provides an image forming apparatus wherein the discharge means is a red LED.

DESCRIPTION OF THE PREFERRED EMBODIMENTS

Figure 1:
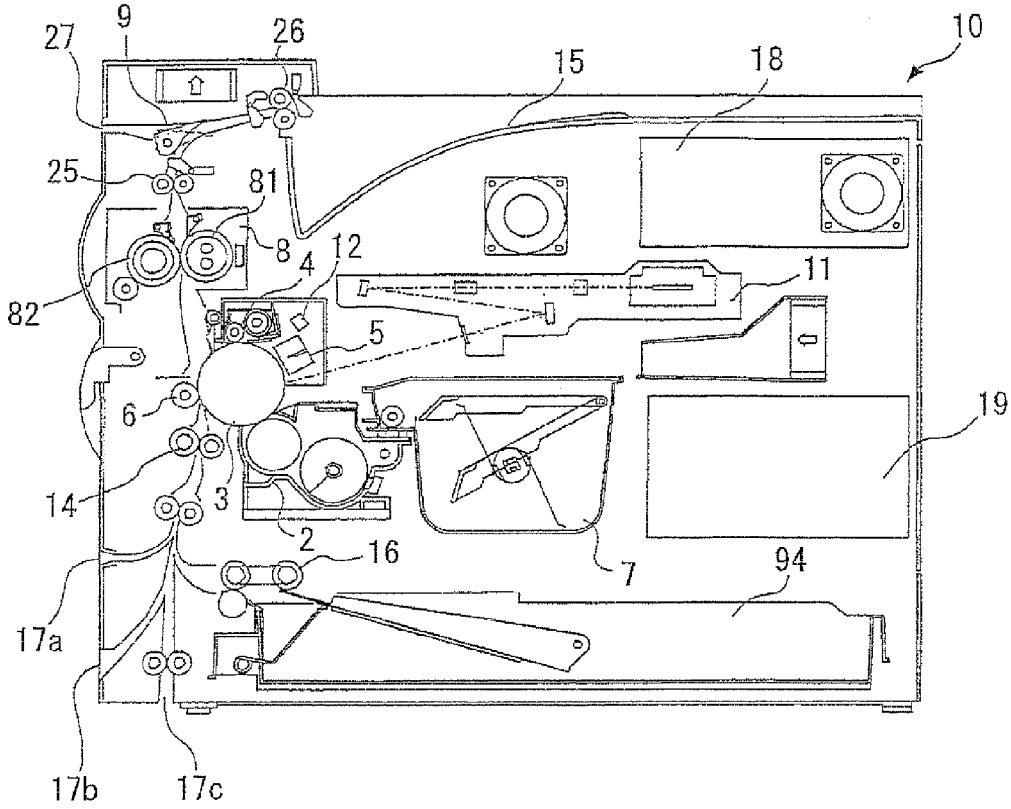
FIG. 1 is a schematic cross sectional view illustrating an image forming apparatus of the present invention.

Use of the photoconductor containing a titanylphthalocyanine having absorption in a wavelength region of 380 nm to 420 nm and a wavelength region of 600 nm to 850 nm allows exposure with light of 380 nm to 420 nm and elimination of residual charges with light of 600 nm to 850 nm. In addition, use of light having a short wavelength of 380 nm to 420 nm (blue light) as the exposure light allows the spot diameter of writing light to be smaller, that is, allows improvement of resolution. Furthermore, use of light having a long wavelength of 600 nm to 850 nm (red light) as the discharge light, which constitutes most of the total amount of light applied to the photoconductor, allows minimization of photo-deterioration in the photoconductor due to short-wavelength light. As a result, it is possible to achieve image formation in high printing resolution and with less image quality degradation over a long period of time.

The term "high printing resolution" used in the present invention means so-called 600×1200 dpi resolution, 1200×1200 dpi resolution, 1200×2400 dpi resolution, 2400×2400 dpi resolution, or the like.

The term "standard printing resolution" used in the present invention means so-called 600×600 dpi resolution.

The photoconductor included in the image forming apparatus according to the present invention may be a multilayer photoconductor in which a charge generation layer containing a charge generation material and a charge transfer layer containing a charge transfer material are formed on a conductive support in this order.

Alternatively, the multilayer photoconductor in the present invention may have an interlayer, a charge generation layer, and a charge transfer layer formed on a conductive support in this order.

Alternatively, the multilayer photoconductor in the present invention may have a charge generation layer, a charge transfer layer, and a protective layer formed on a conductive support in this order.

Further alternatively, the multilayer photoconductor in the present invention may have an interlayer, a charge generation layer, a charge transfer layer, and a protective layer formed on a conductive support in this order.

In addition, the photoconductor of the present invention may be a single-layer photoconductor in which a photosensitive layer containing a charge generation material and a charge transfer material is formed on a conductive support. The single-layer photoconductor may optionally have the above-mentioned interlayer and/or protective layer.

Conductive Support

The conductive support is not particularly limited as long as it has a function as an electrode of a multilayer photoconductor and a function as a supporting member, and the material thereof is selected from those used in the art.

Specific examples thereof include metallic materials such as aluminum, aluminum alloy, copper, zinc, stainless steel, titanium; and materials obtained by laminating a metallic foil, vapor-depositing a metallic material, or vapor-depositing or applying a layer of a conductive compound such as conductive polymers, tin oxides, indium oxides onto a surface of a support formed of a polymeric material such as polyethylene terephthalate, polyamide, polyester, polyoxymethylene, and polystyrene, or hard paper, glass, or the like.

The shape of the conductive support is not limited and it may be sheet-like, cylindrical, columnar, endless belt-like, or the like.

As needed, the surface of the conductive support may be processed by anodic oxidation coating treatment, surface treatment using chemicals or hot water, coloring treatment, or irregular reflection treatment such as surface roughening to the extent that the image quality is not adversely affected.

Charge Generation Layer

The charge generation layer is characterized by containing a charge generation material that generates charges by absorbing light having a wavelength of 380 nm to 420 nm and light having a wavelength of 600 nm to 850 nm.

Specifically, the inventors of the present invention have found that a titanylphthalocyanine having a specific crystal structure that allows absorption of light rays having different wavelengths in a near-infrared region and in an ultraviolet region functions as a charge generation material for both exposure light and discharge light having different wavelengths in an ultraviolet region and in a near-infrared region.

Figure 2:
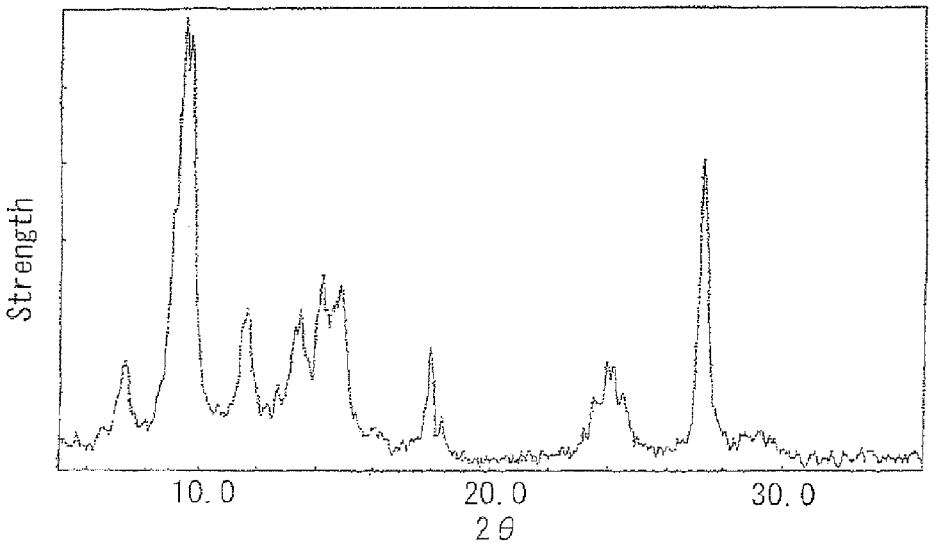
FIG. 2 is a drawing illustrating an X-ray diffraction spectrum for CuKα characteristic X-rays (wavelength: 1.5418 Å) of a photoconductor applicable to the present invention.

More specifically, the titanylphthalocyanine used as a charge generation material in the present invention is preferably a crystalline titanylphthalocyanine having major peaks in an X-ray diffraction spectrum for CuKα characteristic X-rays (wavelength: 1.5418 Å) at Bragg angles (2θ±0.2°) of 7.3°, 9.4°, 9.6°, and 27.2°, in which a peak bundle formed by overlapping the peaks at 9.4° and 9.6° is the largest peak, and the peak at 27.2° is the second largest peak as illustrated in FIG. 2.

That is, the inventors of the present invention have found that a photoconductor containing the titanylphthalocyanine used in the present invention has absorption bands of light rays in the different regions of 380 nm to 420 nm and 600 nm to 850 nm, and that it is possible to match these absorption bands, and the wavelength of the exposure light and the wavelength of the discharge light.

The position of each absorption band varies according to the central metal and the crystal type of the phthalocyanine, and besides the crystalline titanylphthalocyanine of the present invention, any substance may be used for the image forming apparatus of the present invention as long as the substance has a Soret band in this position.

The charge generation layer may contain a binder resin for the purpose of improving its binding property.

As the binder resin, resins used in the art and having a binding property may be used, and those having excellent compatibility with the charge generation material are preferable.

Specific examples thereof include polyester resins, polystyrene resins, polyurethane resins, phenol resins, alkyd resins, melamine resins, epoxy resins, silicone resins, acrylic resins, methacrylate resins, polycarbonate resins, polyarylate resins, phenoxy resins, polyvinyl butyral resins, polyvinyl formal resins, copolymer resins including two or more repeat units that form the above-mentioned resins, and the like.

Examples of the copolymer resins include isolating resins such as vinyl chloride/vinyl acetate copolymer resins, vinyl chloride/vinyl acetate/maleic anhydride copolymer resins, and acrylonitrile/styrene copolymer resins. The binder resin is not limited to the above-mentioned resins, and any resin generally used in the art may be used as the binder resin.

These binder resins can be used independently or in combination of two or more kinds thereof.

Though not particularly limited, the proportion of the binder resin is 0.5 to 2.0 parts by weight with respect to 100 parts by weight of the charge generation material.

As needed, the charge generation layer may contain an appropriate amount of one or more kinds selected from hole transport materials, electron transport materials, antioxidants, ultraviolet absorbers, dispersion stabilizers, sensitizers, leveling agents, plasticizers, fine particles of an inorganic compound or an organic compound, and the like.

Blending of a plasticizer and a leveling agent allows improvement of coatability, flexibility, and surface smoothness.

Examples of the plasticizer include dibasic acid esters such as phthalate esters, fatty acid esters, phosphoric esters, chlorinated paraffins, epoxy type plasticizers, and the like.

Examples of the leveling agent include silicone type leveling agents.

The charge generation layer can be formed by a commonly known dry process and wet process.

Examples of the dry process include a method in which a charge generation material is vacuum deposited on a conductive support.

Examples of the wet process include a method in which a charge generation material and, as needed, a binder resin are dissolved or dispersed in an appropriate organic solvent to prepare a coating solution for charge generation layer formation, and the coating solution is applied to a surface of a conductive support or a surface of an interlayer formed on the conductive support, and then dried to remove the organic solvent.

Examples of the solvent used for the coating solution for charge generation layer formation include halogenated hydrocarbons such as dichloromethane and dichloroethane; Ketones such as acetone, methyl ethyl ketone, and cyclohexanone; esters such as ethyl acetate and butyl acetate; ethers such as tetrahydrofuran (THF) and dioxane; alkyl ethers of ethylene glycol such as 1,2-dimethoxyethane; aromatic hydrocarbons such as benzene, toluene and xylene; and aprotic polar solvents such as N,N-dimethylformamide and N,N-dimethylacetamide. Out of these solvents, non-halogen organic solvents are preferably used in terms of global environmental consideration. These solvents can be used independently or in combination of two or more kinds thereof.

The charge generation material may be milled in advance by use of a milling machine before dissolved or dispersed in a solvent. Examples of the milling machine include a ball mill, a sand mill, an attritor, an oscillation mill, an ultrasonic dispersing machine, and the like.

For dissolving or dispersing the charge generation material in a solvent, a dispersing machine such as a paint shaker, a ball mill, and a sand mill may be used. On this occasion, it is preferable to appropriately set dispersion conditions so as to prevent contamination of the coating solution with impurities generated due to abrasion or the like of materials forming the container and the dispersing machine.

As the application method for the coating solution for charge generation layer formation, an optimal method may be appropriately selected in consideration of the physical properties of the coating solution and productivity. Examples thereof include a spraying method, a bar coating method, a roll coating method, a blade method, a ring method, a dipping coating method, and the like.

Out of these application methods, the dipping coating method is relatively simple and advantageous in terms of productivity and costs, and therefore can be suitably used for the production of the photoconductor. In the dipping coating method, a substrate is immersed in a coating vessel filled with the coating solution, and then raised at a constant rate or at a rate that changes successively to form a layer on the surface of the substrate. The apparatus used for the dipping coating method may be provided with a coating solution disperser represented by an ultrasonic generator to stabilize dispersibility of the coating solution.

The temperature in the step of drying the coating film is not particularly limited, as long as the temperature allows removal of the used organic solvent, and is preferably 50° C. to 140° C., particularly preferably 80° C. to 130° C.

The drying temperature of less than 50° C. may prolong drying time. On the other hand, the drying temperature of more than 140° C. may cause deterioration in the electric properties of the photoconductor in repeated use and degradation of images to be obtained.

Such a temperature condition in the production of the photosensitive layer is common to formation of other layers including the interlayer and other treatments to be described later as well as the photosensitive layer.

Though not particularly limited, the film thickness of the charge generation layer is preferably 0.05 μm to 5 μm, particularly preferably 0.1 μm to 1 μm.

The film thickness of the charge generation layer of less than 0.05 μm may lead to reduction in the light absorption efficiency to reduce the sensitivity of the photoconductor. On the other hand, the film thickness of the charge generation layer of more than 5 μm may cause the transfer of charges in the charge generation layer to be a rate-determining step in a process of removing charges on the surface of the photosensitive layer to reduce the sensitivity of the photoconductor.

Charge Transfer Layer

The charge transfer layer contains an amine compound as a charge transfer material and a binder resin.

The content of the amine compound is preferably 5% to 70% by weight of the charge transfer layer.

The content of the amine compound of less than 5% by weight may lead to failure in transferring charges to reduce the sensitivity. On the other hand, the content of the amine compound of more than 70% by weight may lead to reduction of the film strength.

The binder resin may be contained for the purpose of, for example, improving the mechanical strength, durability, and the like of the charge transfer layer.

As the binder resin, transparent resins that do not absorb light having a wavelength of 380 nm to 420 nm may be used out of resins used in the art and having a binding property, and the same resins as contained in the charge generation layer may be used independently or in combination of two ore more kinds thereof.

Out of those mentioned, polystyrenes, polycarbonates, polyarylates, and polyphenylene oxides are preferable as having a volume resistivity of $10^{13}\Omega$ or more to show excellent electrical insulation properties and having excellent coatability, potential characteristics, and the like, among which polycarbonates are particularly preferable.

Though not particularly limited, the proportion of the binder resin is approximately 50 parts by weight to 300 parts by weight with respect to 100 parts by weight of the charge transfer material.

As needed, the charge transfer layer may contain an appropriate amount of one or more kinds selected from hole transport materials, electron transport materials, antioxidants, ultraviolet absorbers, dispersion stabilizers, sensitizers, leveling agents, plasticizers, fine particles of an inorganic compound or an organic compound, and the like.

Blending of an antioxidant and an ultraviolet absorber allows reduction of deterioration in the photosensitive layer due to oxidizing gas such as ozone and nitrogen oxides, and improvement in the stability of the coating solution. Blending of these agents is therefore preferable for the charge transfer layer to be a top layer of the photoconductor.

Examples of the antioxidant include phenol compounds, hydroquinone compounds, tocopherol compounds, and amine compounds, and the like among which hindered phenolic derivatives, hindered amine derivatives, and mixtures thereof are particularly preferable.

The content of the antioxidant is preferably 0.1 parts by weight to 50 parts by weight with respect to 100 parts by weight of the charge transfer material.

The content of the antioxidant of less than 0.1 parts by weight may lead to failure in obtaining sufficient effects for improvement in the stability of the coating solution and improvement in the durability of the photoconductor. On the other hand, the content of the antioxidant of more than 50 parts by weight may have an adverse effect on the properties of the photoconductor.

As in the case of the charge generation layer, the charge transfer layer can be formed by preparing a coating solution for charge transfer layer formation and by using a wet process, particularly a dipping coating method.

As the solvent used for the preparation of the coating solution for charge transfer layer formation, the same solvents as used for the preparation of the coating solution for charge generation layer formation may be used independently or in combination of two or more kinds thereof.

The other steps and conditions therefor are in accordance with those for the formation of the charge generation layer. Though not particularly limited, the film thickness of the charge transfer layer is preferably 5 μm to 40 μm, particularly preferably 10 μm to 30 μm.

The film thickness of the charge transfer layer of less than 5 μm may lead to deterioration in the charge retention ability on the surface of the photoconductor to reduce the contrast of output images. On the other hand, the film thickness of the charge transfer layer of more than 100 μm may lead to reduction of the productivity of the photoconductor.

In addition, the charge transfer layer preferably allows both light having a wave length of 380 nm to 420 nm, which is a wavelength of the exposure light, and light having a wavelength of 600 nm to 850 nm to pass therethrough.

Interlayer (Undercoat Layer)

The photoconductor of the present invention preferably has an interlayer between the conductive support and the multilayer photosensitive layer.

The interlayer has a function of preventing injection of charges from the conductive support to the multilayer photosensitive layer. That is, deterioration of the multilayer photosensitive layer in the chargeability is inhibited, and decrease of surface charges in the part other than that to be eliminated by exposure is limited, preventing generation of images having a defect such as fogging. In particular, it is possible to prevent occurrence of fogging of images called black dots, that is, fine black dots of toner formed on a white background in image formation by a reverse developing process.

In addition, the interlayer that coats the surface of the conductive support can reduce the degree of roughness, which is a defect of the surface of the conductive support, and can even the surface to improve the coatability of the multilayer photosensitive layer, thereby improving adhesion between the conductive support and the multilayer photosensitive layer.

The interlayer can be formed by, for example, dissolving a resin material in an appropriate organic solvent to prepare a coating solution for interlayer formation, and applying the coating solution onto the conductive support, and then drying the same to remove the organic solvent.

Examples of the resin material include natural polymer materials such as casein, gelatin, polyvinyl alcohol, and ethyl cellulose as well as the same binder resins as contained in the charge generation layer and the charge transfer layer, and one or more kinds thereof may be used. Out of these resins, polyamide resins are preferable, and alcohol-soluble nylon resins are particularly preferable.

Examples of the alcohol-soluble nylon resins include so-called copolyamides obtained by copolymerizing 6-nylon, 6,6-nylon, 6,10-nylon, 11-nylon, 2-nylon, 12-nylon, and the like; and resins obtained by chemically modifying nylon such as N-alkoxymethyl-modified nylon and N-alkoxyethyl-modified nylon.

Examples of the solvent in which the resin material is dissolved or dispersed include water; alcohols such as methanol, ethanol, and butanol; glymes such as methyl carbitol and butyl carbitol; chlorine-based solvents such as dichloroethane, chloroform, and trichloroethane; acetone; dioxolane; mixed solvents obtained by mixing two or more of these solvents. Out of these solvents, non-halogen organic solvents are preferably used in terms of global environmental consideration.

The other steps and conditions therefor are in accordance with those for the formation of the charge generation layer and the charge transfer layer.

In addition, the coating solution for interlayer formation may contain metallic oxide particles.

The metallic oxide particles can easily adjust the volume resistivity of the interlayer to allow further prevention of the injection of charges to the multilayer photosensitive layer and maintenance of the electric properties of the photoconductor under various environments.

Examples of the metallic oxide particles include titanium oxide, aluminum oxide, aluminum hydroxide, and tin oxide particles.

When the total weight of the resin material and the metallic oxide particles in the coating solution for interlayer formation is C, and the weight of the solvent is D, the ratio therebetween (C/D) is preferably 1/99 to 40/60, particularly preferably 2/98 to 30/70.

In addition, when the weight of the resin material is E, and the weight of the metallic oxide particles is F, the ratio therebetween (E/F) is preferably 90/10 to 1/99, particularly preferably 70/30 to 5/95.

Though not particularly limited, the film thickness of the interlayer is preferably 0.01 μm to 20 μm, particularly preferably 0.05 μm to 10 μm.

The film thickness of the interlayer of less than 0.01 μm may cause the layer to fail in substantially functioning as an interlayer and in providing an even surface by coating the defect of the conductive support. That is, in this case, the injection of charges from the conductive support to the multilayer photosensitive layer cannot be prevented, leading to deterioration of the multilayer photosensitive layer in the chargeability. On the other hand, the film thickness of the interlayer of more than 20 μm may make it difficult to form an even interlayer and to form an even multilayer photosensitive layer on the interlayer, reducing the sensitivity of the photoconductor.

When the material for forming the conductive support is aluminum, a layer containing alumite (alumite layer) may be formed as an interlayer.

Protective Layer

The photoconductor of the present invention may have a protective layer on the multilayer photosensitive layer.

The protective layer may has a function of improving the durability of the photoconductor and is made of a binder resin. The protective layer may contain one or more kinds of the same charge transfer materials as contained in the charge transfer layer.

Examples of the binder resin include the same binder resins as contained in the charge generation layer and the charge transfer layer.

The protective layer can be formed by, for example, dissolving a binder resin in an appropriate organic solvent to prepare a coating solution for protective layer formation, and applying the coating solution onto the multilayer photosensitive layer, and then drying the same to remove the organic solvent.

The other steps and conditions therefor are in accordance with those for the formation of the charge generation layer and the charge transfer layer.

Though not particularly limited, the film thickness of the protective layer is preferably 0.5 μm to 10 μm, particularly preferably 1 μm to 5 μm.

The film thickness of the protective layer of less than 0.5 μm may lead to poor abrasion resistance in the surface of the photoconductor and insufficient durability. On the other hand, the film thickness of the protective layer of more than 10 μm may lead to decrease in the resolution of the photoconductor.

In addition, the protective layer needs to allow both light in a wavelength region of 380 nm to 420 nm, which is a wavelength of the exposure light, and light in a wavelength region of 600 nm to 850 nm to pass therethrough.

The image forming apparatus of the present invention comprises: a multilayer photoconductor of the present invention; a charge means for charging the photoconductor; an exposure means for exposing the charged photoconductor with light having a wavelength of 380 nm to 420 nm to form an electrostatic latent image; and a discharge means for discharging, after cleaning, the photoconductor with light having a wavelength of 600 nm to 850 nm to eliminate the electrostatic latent image remaining on the surface of the photoconductor.

Exposure Means

Suitable examples of the exposure means as a light source of the exposure light having a wavelength of 380 nm to 420 nm used in the image forming apparatus according to the present invention include blue laser diodes.

More specifically, examples of the above-mentioned light source include blue laser diodes GH04020B2AE and GH04020A2GE manufactured by Sharp Corporation.

Discharge Means

Examples of the discharge means as a light source of the discharge light having a wavelength of 600 nm to 850 nm used in the image forming apparatus according to the present invention include lamp bulbs such as halogen lamps and fuse bulbs; discharge tube lamps such as fluorescent lamps; semiconductor devices such as LED lamps; and various light emitting devices such as EL elements.

From the viewpoint of miniaturization or reduction of electric power consumption and heat evolution, power-saving devices such as LEDs are particularly preferable.

Examples of the LEDs as the power-saving devices include LEDs such as of HD series, D series, TR series, T series, UR series, U series, PR series, P series, and the like out of LEDs manufactured by Sharp Corporation.

A plurality of such light emitting elements may be arranged linearly in a direction of the axis of the photoconductor to form a linear light source so as to directly irradiate the surface of the photoconductor, or light from one or more light emitting elements may be arranged so as to be guided to the surface of the photoconductor by a light guiding member or the like.

In addition, a band-pass filter may be provided in an optical path between the light source and the surface of the photoconductor so as to obtain light having a desired wavelength, that is, 600 nm or more, or a diffusion filter or the like may be provided so as to obtain uniform distribution of the light amount on the surface of the photoconductor.

Next, an image forming apparatus for use in examples will be described with reference to the drawings.

FIG. 1 illustrates a structure of an image forming apparatus 10. As illustrated in FIG. 1, the image forming apparatus 10 is to record and output image data from an externally connected device such as a personal computer as well as record and output images read by an image-reading device (not shown).

In the image forming apparatus 10, processing units that carry out each function of the image formation process are disposed around a photosensitive drum 3. Around the photosensitive drum 3, there are disposed in order: a charge means 5 for uniformly charging the surface of the photosensitive drum 3; a light-scanning unit 11 that functions as an exposure means for performing exposure and scanning on the uniformly charged photosensitive drum 3 to write an electrostatic latent image; a development unit 2 for developing the electrostatic latent image written by the light-scanning unit 11 with a developer supplied from a developer reservoir 7; a transfer means 6 for transferring the image developed on the photosensitive drum 3 onto a paper sheet; a cleaning unit 4 for removing the developer remaining on the photosensitive drum 3; a discharge lamp unit 12 that functions as a discharge means for removing charges on the surface of the photosensitive drum 3; and so on.

At an upstream side with respect to a transfer position located between the photosensitive drum 3 and the transfer means 6 on a sheet transporting path, a registration roller 14 is disposed for guiding a paper sheet to the transfer position with predetermined timing. On the other hand, at a downstream side with respect to the transfer position on the sheet transporting path, a fixing device 8 is disposed for fixing an unfixed developer image adhering to a paper sheet on the paper sheet.

In a lower part of the image forming apparatus 10, a sheet feeding tray 94 is disposed to be included in the main body of the image forming apparatus 10. In the vicinity of the sheet feeding tray 94, a pickup roller 16 is disposed for separating a top paper sheet contained in the sheet feeding tray 94 and guiding the paper sheet to the sheet transporting path.

The sheet feeding tray 94 is a tray for containing paper sheets, and the paper sheets contained in the sheet feeding tray 94 are separated one by one to be fed to an image forming section. The paper sheets separated one by one from the sheet feeding tray 94 by the pickup roller 16 are timed to go along with the operation of the image formation process performed around the photosensitive drum 3 by the registration roller 14 on the sheet transporting path to be sequentially fed to the transfer position between the transfer means 6 and the photosensitive drum 3.

In this transfer position, the developer image formed on the photosensitive drum 3 is transferred onto a paper sheet by the action of a transfer voltage of the transfer means 6. Supply of paper sheets to this sheet feeding tray 94 is performed by drawing out the sheet feeding tray 94 from the front of the image forming apparatus 10. In addition, in the bottom of the image forming apparatus 10, there are provided a sheet feeder having multistage sheet feeding trays prepared as a peripheral device, not shown, and sheet receivers 17 (17*a* to 17*c*) for receiving paper sheets sent from the sheet feeder capable of containing a large quantity of paper sheets and for sequentially feeding the paper sheets to the image forming section.

The paper sheets that have passed the transfer position are guided to the fixing device 8. In the fixing device 8, the paper sheets on which images are transferred are received sequentially, and the unfixed development images transferred onto the paper sheets are fixed by heat and pressure by a fixing roller 81, a pressure roller 82, and the like. The paper sheets on which the images are fixed are conveyed to a further downstream side on the sheet transporting path by a conveyance roller 25 and guided to a switching gate 9.

The present image forming apparatus is a modification of a commercially available copying machine, AR-625S™, manufactured by Sharp Corporation and capable of performing writing exposure with laser beams having a variety of wavelengths by changing the light-scanning unit 11. Likewise, the image forming apparatus is capable of performing discharge with discharge light having a variety of wavelengths by changing the discharge lamp unit 12.

Next, production examples of a titanylphthalocyanine used in the examples and a photoconductor A containing the titanylphthalocyanine will be described.

PRODUCTION EXAMPLE 1

Production of Titanylphthalocyanine

A diiminoisoindoline in an amount of 29.2 g and sulfolane in an amount of 200 ml were mixed, and titanium tetraisopropoxide in an amount of 17.0 g was added thereto to be reacted under a nitrogen atmosphere at 140° C. for 2 hours. A precipitate was filtered off after cooling, and washing with chloroform, washing with a 2% aqueous hydrochloric acid solution, washing with water, washing with methanol, and drying were performed to obtain 25.5 g of a titanylphthalocyanine (yield 88.5%) represented by the following formula:

[Formula 1]

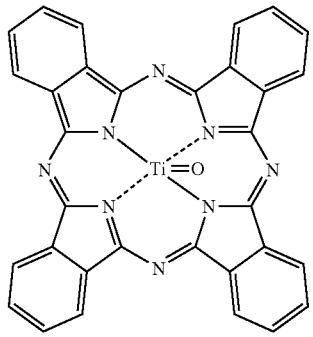

Figure 3:
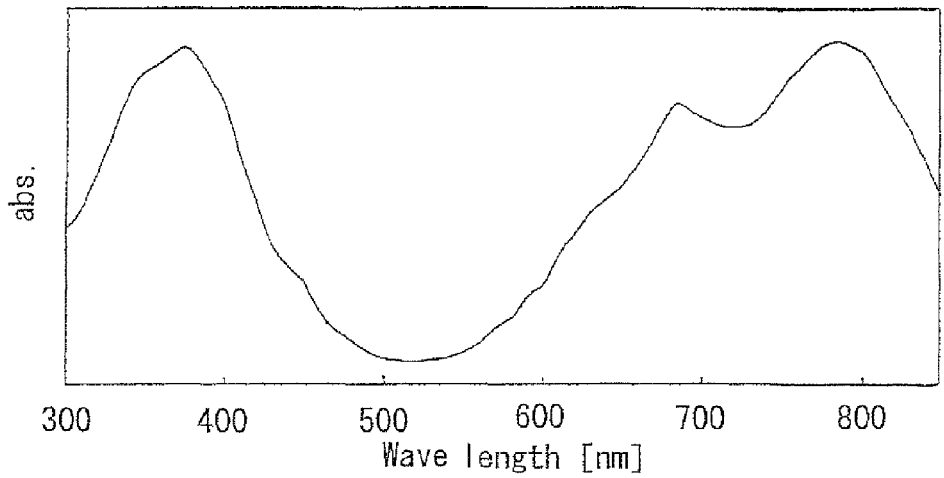
FIG. 3 is a drawing illustrating an absorbance characteristic of the photoconductor applicable to the present invention.

The titanylphthalocyanine obtained was confirmed to be a crystalline titanylphthalocyanine having major peaks in an X-ray diffraction spectrum for CuKα characteristic X-rays (wavelength: 1.5418 Å) at Bragg angles (2θ±0.2°) of 7.3°, 9.4°, 9.6°, and 27.2°, in which a peak bundle formed by overlapping the peaks at 9.4° and 9.6° is the largest peak, and the peak at 27.2° is the second largest peak as illustrated in FIG. 2, and to be a titanylphthalocyanine having absorption in a wavelength region of 380 nm to 420 nm and a wavelength region of 600 nm to 850 nm as illustrated in FIG. 3.

PRODUCTION EXAMPLE 2

Production of Photoconductor A

The photoconductor A was produced according to the following method.

A titanium oxide (trade name: TIPAQUE® TTO-D-1, product by ISHIHARA SANGYO KAISHA, LTD.) in an amount of 3 parts by weight and a commercially available polyamide resin (trade name: AMILAN® CM8000, product by Toray Industries, Inc.) in an amount of 2 parts by weight were added to methyl alcohol in an amount of 25 parts by weight and dispersed with the use of a paint shaker for 8 hours to produce 3 kg of a coating solution for undercoat layer formation. The coating solution for undercoat layer formation obtained was subjected to cutting (processed into a ten-point surface roughness RzJIS according to JISB-0601 of 0.80 μm), and then applied to an aluminum conductive support with a washed surface having a diameter of 80 mm and a length of 348 mm by a dipping coating method to form an undercoat layer having a film thickness of 1 μm.

The titanylphthalocyanine obtained in Production Example 1 as described above in an amount of 1 part by weight and a butyral resin (trade name: BM-2™, product by Denki Kagaku Kogyo K.K.) in an amount of 1 part by weight were mixed with methyl ethyl ketone in an amount of 98 parts by weight and dispersed with the use of a paint shaker to prepare 3 kg of a coating solution for charge generation layer formation. The coating solution for charge generation layer formation was applied to the surface of the undercoat layer in the same manner as in the undercoat layer formation and air dried to form a charge generation layer having a film thickness of 0.3 μm.

Subsequently, 100 parts by weight of a triphenylamine compound (TPD) (trade name: D2448™, product by Tokyo Chemical Industry Co., Ltd.) as a charge transfer material having the following structure,

[Formula 2]

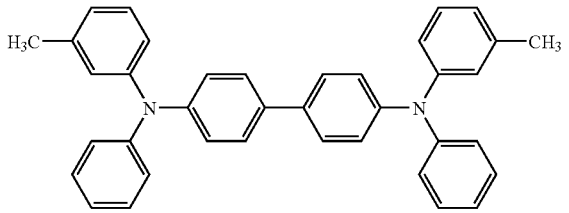

150 parts by weight of a polycarbonate resin (TS2050™: product by TEIJIN CHEMICALS LTD.), and 0.02 parts by weight of a silicone oil (trade name: SH200™, product by Dow Corning Toray) were mixed and dissolved in tetrahydrofuran as a solvent to prepare 3 kg of a coating solution for charge transfer layer formation having a solid content of 25% by weight. The coating solution for charge transfer layer formation was applied to the surface of the charge generation layer prepared in advance by a dipping coating method and dried at 120° C. for 1 hour to form a charge transfer layer having a film thickness of 25 μm. Thus, the photoconductor A as a multilayer photoconductor was produced.

PRODUCTION EXAMPLE 3

Production of Photoconductor B

Figure 4:
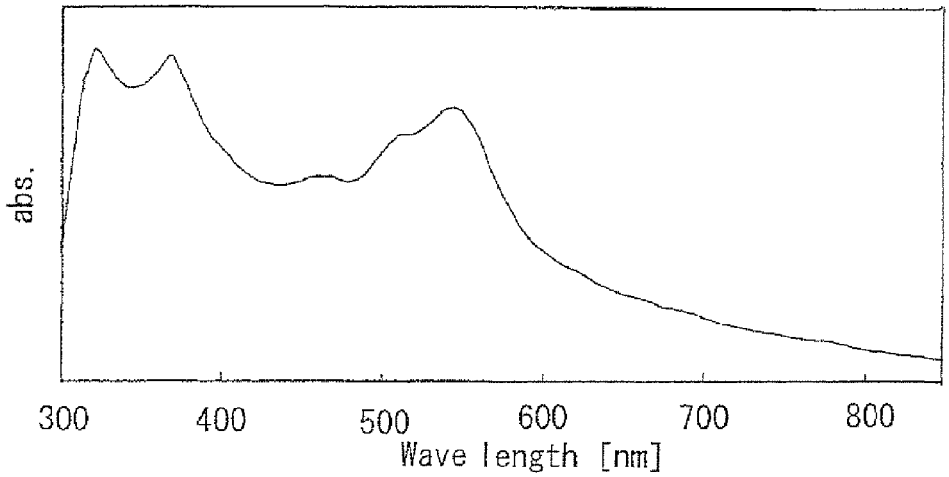
FIG. 4 is a drawing illustrating an absorbance characteristic of a photoconductor applicable to comparative examples.

The photoconductor B was produced in the same manner as in the method for producing the photoconductor A in Production Example 2 except that a dibromoanthanthrone (model number: D01148, product by ZENECA limited) having absorbance as illustrated in FIG. 4 was used instead of the titanylphthalocyanine used as the charge generation material.

EXAMPLE 1

Example 1 formed by combining the photoconductor A produced in Production Example 2 and the image forming apparatus 10 described earlier will be described.

The photoconductor A was incorporated into the image forming apparatus 10 which had been set up as follows. That is, the photoconductor A was incorporated into the image forming apparatus 10 in which the light-scanning unit 11 is changed to a light-scanning unit using a laser beam having a wavelength of 405 nm and including an optical system enabled for 1200 dpi, and the discharge lamp unit 12 was unchanged to provide red light as in the original AR-625S™. Here, the maximum exposure light amount was adjusted to be an amount that gives a light potential of the photoconductor A of −60 V±5 V.

The discharge light amount was as in the original AR-625S™. Thus, the image forming apparatus was configured to output print images and carry out a durability evaluation test. Naturally, high-definition and satisfactory images were obtained in an initial stage, and such high-definition and satisfactory images were obtained even the number of sheets tested was increased until it reached approximately 125 k sheets. Thereafter, images at an acceptable level were obtained until the number of sheets tested reached 200 k sheets, though some image deterioration occurred. Table 1 shows the results.

For comparison with Example 1, Table 1 includes results of Comparative Examples 1 to 3 in which the same photoconductor A as in Example 1 was used, and exposure conditions and discharge conditions in the image forming apparatus 10 were varied; and results of Comparative Examples 4 to 7 in which a photoconductor (photoconductor B described in Production Example 3) that is different from that in Example 1 was used. Hereinafter, Comparative Examples 1 to 7 will be described.

COMPARATIVE EXAMPLE 1

The photoconductor A was incorporated into the image forming apparatus 10 in which the same light-scanning unit as in Example 1 (405 nm of wavelength, 1200 dpi) was used as the light-scanning unit 11 and a discharge lamp unit including blue LEDs (NS4C107T™, product by Nichia Corporation) arranged and implemented was used as the discharge lamp unit 12. The maximum exposure light amount was adjusted to be the same amount as in Example 1, and the discharge light amount was adjusted to be the same as in the original AR-625S™ when positioned on the surface of the photoconductor to prepare the image forming apparatus.

COMPARATIVE EXAMPLE 2

The photoconductor A was incorporated into the image forming apparatus 10 in which a light-scanning unit of the original AR-625S™ (780 nm of wavelength, 600 dpi for standard images) was used as the light-scanning unit 11, and the same discharge lamp unit (blue light) as in Comparative Example 1 was used as the discharge lamp unit 12. The maximum exposure light amount was adjusted to be an amount that gives a light potential of the photoconductor A of −60 V±5 V as in the case of Example 1, and the discharge light amount was adjusted to be the same amount as in Comparative Example 1 to prepare the image forming apparatus.

COMPARATIVE EXAMPLE 3

The photoconductor A was incorporated into the image forming apparatus 10 in which the same light-scanning unit as in Comparative Example 2 (780 nm of wavelength, 600 dpi) was used as the light-scanning unit 11, and the same discharge lamp unit as in Example 1 (red light as in the original AR-625S™) was used as the discharge lamp unit 12. The maximum exposure light amount was adjusted to be the same amount as in Comparative Example 1, and the discharge light amount was adjusted to be the same amount as in Example 1 to prepare the image forming apparatus.

COMPARATIVE EXAMPLE 4

The photoconductor B was incorporated into the image forming apparatus 10 in which the same light-scanning unit as in Example 1 (405 nm of wavelength, 1200 dpi) was used as the light-scanning unit 11, and the same discharge lamp unit as in Example 1 (red light) was used as the discharge lamp unit 12. The maximum exposure light amount was adjusted to be an amount that gives a light potential of the photoconductor B of −60 V±5 V as in the case of Example 1, and the discharge light amount was adjusted to be the same amount as in Example 1 to prepare the image forming apparatus.

COMPARATIVE EXAMPLE 5

The photoconductor B was incorporated into the image forming apparatus 10 in which the same light-scanning unit as in Example 1 (405 nm of wavelength, 1200 dpi) was used as the light-scanning unit 11, and the same discharge lamp unit as in Comparative Example 1 (blue light) was used as the discharge lamp unit 12. The maximum exposure light amount was adjusted to be the same amount as in Comparative Example 4, and the discharge light amount was adjusted to be the same amount as in Comparative Example 1 to prepare the image forming apparatus.

COMPARATIVE EXAMPLE 6

The photoconductor B was incorporated into the image forming apparatus 10 in which the same light-scanning unit as in Comparative Example 2 (780 nm of wavelength, 600 dpi) was used as the light-scanning unit 11, and the same discharge lamp unit as in Comparative Example 1 (blue light) was used as the discharge lamp unit 12. The discharge light amount was adjusted to be the same amount as in Comparative Example 1, and then the maximum exposure light amount was supposed to be adjusted to be an amount that gives a light potential of the photoconductor B of −60 V±5 V as in the case of Example 1. However, the light potential hardly changed from the dark potential even though the light amount was set to be sufficiently high compared with Comparative Examples 1 to 6 or Example 1, failing to give a value of approximately −60 V.

That is, this image forming apparatus was not able to produce satisfactory images from the initial stage.

COMPARATIVE EXAMPLE 7

The photoconductor B was incorporated into the image forming apparatus 10 in which the same light-scanning unit as in Comparative Example 2 (780 nm of wavelength, 600 dpi) was used as the light-scanning unit 11, and the same discharge lamp unit as in Example 1 (red light) was used as the discharge lamp unit 12. The discharge light amount was adjusted to be the same amount as in Example 1. The maximum exposure light amount was supposed to be adjusted to be an amount that gives a light potential of the photoconductor B of −60 V±5 V as in the case of Example 1. However, the light potential hardly changed from the dark potential even though the light amount was set to be sufficiently high as in the case of Comparative Example 6.

That is, this image forming apparatus was not able to produce satisfactory images from the initial stage. Evaluation of each image forming apparatus A durability test was carried out by use of image forming apparatuses prepared in Example 1 and Comparative Examples 1 to 7. The following table shows the results.

The image forming apparatuses prepared in the example and the comparative examples were evaluated according to the following criteria.

VG: An extremely excellent image was obtained with a sufficient print density; no image defects such as blurring, roughness, and flaws; and high definition and high resolution.

G: An excellent image was obtained with a sufficient print density; and no image defects such as blurring, roughness, and flaws.

NB: An image at a fully acceptable level and of satisfactory quality was obtained with some lowering in print density; or blurring and flaws at an unrecognizable level unless carefully observed (no problem at a glance).

B: An image of poor quality was obtained with lowering in density, image defects such as blurring and flaws, problems such as ghost memories, recognized at a glance at print as a whole.

VB: An image of extremely poor quality and in a worse state than B was obtained with significant image defects.

TABLE 1

| | Photo-conductor | Exposure wavelength [nm] | Discharge light | Initial stage | 25k sheets | 50k sheets | 75k sheets | 100k sheets | 125k sheets | 150k sheets | 175k sheets | 200k sheets |
|---|---|---|---|---|---|---|---|---|---|---|---|---|
| Example 1 | Photo-conductor A | 405 | red | VG | VG | VG | VG | VG | VG | NB | NB | NB |
| Comparative Example 1 | | 405 | blue | VG | VG | VG | NB | B | B | VB | VB | VB |
| Comparative Example 2 | | 780 | blue | G | G | G | NB | B | B | VB | VB | VB |
| Comparative Example 3 | | 780 | red | G | G | G | G | G | G | NB | NB | NB |
| Comparative Example 4 | Photo-conductor B | 405 | red | B | B | B | B | B | B | B | B | B |
| Comparative Example 5 | | 405 | blue | VG | VG | VG | NB | B | B | VB | VB | VB |
| Comparative Example 6 | | 780 | blue | Print recognizable as image not obtained. | | | | | | | | |
| Comparative Example 7 | | 780 | red | Print recognizable as image not obtained. | | | | | | | | |

VG: Extremely excellent image level (extremely excellent image of high resolution)
G: Excellent image level (excellent image of normal resolution)
NB: Satisfactory image level (acceptable level), acceptable for normal use
B: Unsatisfactory image level
VB: Extremely unsatisfactory image level (with image defects)

In Example 1 and Comparative Examples 1 to 3 that used the photoconductor A having sufficient sensitivity around a wavelength of 405 nm and around a wavelength of 780 nm, excellent images were obtained under any conditions in an initial stage.

In particular, in Example 1 and Comparative Example 1 that used the exposure light of 405 nm, excellent images were obtained including images of higher resolution reproduced accurately compared with Comparative Examples 2 and 3.

In Comparative Example 5 that used the exposure light of 405 nm and blue light for the discharge light, high-resolution, accurate, and excellent images were obtained in an initial stage. However, the image level lowered when the number of sheets reached 75 k, and images rapidly degraded after the number of sheets reached 100 k.

In addition, the photoconductor was observed after completion of the test when the number of sheets reached 200 k to find that the surface thereof had changed in quality.

The following table summarizes the results again.

TABLE 2

| | | Titanylphthalocyanine photoconductor Exposure light wavelength | | Dibromoanthanthrone photoconductor Exposure light wavelength | |
|---|---|---|---|---|---|
| | | 405 nm | 780 nm | 405 nm | 780 nm |
| Discharge light | Blue | Resolution: G Durability: B (Comparative Example 1) | Resolution: NB Durability: B (Comparative Example 2) | Resolution: G Durability: B (Comparative Example 5) | Image: B (Comparative Example 6) |
| | Red | Resolution: G Durability: G Example 1) | Resolution: NB Durability: G (Comparative (Example 3) | Image: B (Comparative Example 4) | Image: B (Comparative Example 7) |

G: Excellent
NB: Acceptable
B: Unsatisfactory

Furthermore, image formation was repeated to evaluate durability. In Comparative Examples 1 and 2 that used blue light for the discharge light, the image level lowered when the number of sheets reached 75 k, and images rapidly degraded after the number of sheets reached 100 k.

In addition, the photoconductor was observed after completion of the test when the number of sheets reached 200 k to find that the surface thereof had changed in quality.

On the other hand, in Example 1 and Comparative Example 3 that used red light for the discharge light, the initial level of excellent images was maintained even when the number of sheets reached 125 k, and thereafter an acceptable level for images was maintained until the number of sheets reached 200 k, though the image level lowered compared with the initial level.

In addition, the photoconductor was observed after completion of the test when the number of sheets reached 200 k to find that the photoconductor itself did not change in quality, though the surface thereof had been abraded to have fine flaws.

Comparative Examples 4 to 7 used the photoconductor B that has sufficient sensitivity around a wavelength of 405 nm but does not have sufficient sensibility around a wavelength of 780 nm.

In Comparative Examples 6 and 7 that used the exposure light of 780 nm, it was impossible to obtain sensitivity enough to eliminate charges (dark potential). That is, the dark potential was maintained almost as-is even after exposure and, as a result, it was impossible to obtain print that includes a recognizable image, because the image failed to have sufficient density.

In Comparative Example 4 that used the exposure light of 405 nm and red light for the discharge light, images having sufficient density were obtained, but memories of the charges that had been generated by exposure and transfer before the charging step were not eliminated by discharge to generate images suffering from significant ghost memories from the initial stage, preventing generation of proper images.

That is, a high-resolution and highly durable image forming apparatus was obtained by using a titanylphthalocyanine photoconductor and employing light having a blue wavelength as the exposure light and light having a red wavelength as the discharge light.

According to the present invention, a titanylphthalocyanine photoconductor having absorption in a wavelength region of 380 nm to 420 nm and a wavelength region of 600 nm to 850 nm is used to allow exposure with light of 380 nm to 420 nm and elimination of residual charges with light of 600 nm to 850 nm. In addition, light having a short wavelength of 380 nm to 420 nm (blue light) is used as the exposure light to allow the spot diameter of writing light to be smaller, that is, to allow improvement of resolution. Furthermore, light having a long wavelength of 600 nm to 850 nm (red light) is used as the discharge light, which constitutes most of the total amount of the light applied to the photoconductor, to allow minimization of photo-deterioration in the photoconductor due to short-wavelength light. As a result, it is possible to achieve image formation in high printing resolution and with less image quality degradation over a long period of time.

What is claimed is:

1. An image forming apparatus, comprising:

a photoconductor;

a charge means for charging the photoconductor;

an exposure means for irradiating a surface of the photoconductor with light to form an electrostatic latent image;

a development means for developing the electrostatic latent image formed;

a transfer means for transferring the image developed onto a paper sheet; and a discharge means for irradiating the surface of the photoconductor with light to eliminate charges, wherein the photoconductor contains a titanylphthalocyanine having absorption bands in a wavelength region of 380 nm to 420 nm and a wavelength region of 600 nm to 850 nm as a charge generation material, the exposure means irradiates the surface of the photoconductor with light having a wavelength of 380 nm to 420 nm to form the electrostatic latent image, and the discharge means irradiates the surface of the photoconductor with light having a wavelength of 600 nm to 850 nm to eliminate the charges, and wherein the titanylphthalocyanine is a crystalline titanylphthalocyanine having major peaks in an X-ray diffraction spectrum for CuKα characteristic X-rays (wavelength: 1.5418 Å) at Bragg angles (2θ±0.2°) of 7.3°, 9.4°, 9.6°, and 27.2°, in which a peak bundle formed by overlapping the peaks at 9.4° and 9.6° is a largest peak, and the peak at 27.2° is a second largest peak.

2. The image forming apparatus as set forth in claim 1, wherein the exposure means is for printing for high printing resolution.

3. The image forming apparatus as set forth in claim 1, wherein the exposure means is a blue semiconductor laser.

4. The image forming apparatus as set forth in claim 1, wherein the discharge means is a red LED.

* * * * *